US005535763A

United States Patent [19]

Conte

[11] Patent Number: 5,535,763

[45] Date of Patent: Jul. 16, 1996

[54] CIGAR PUNCH AND TOBACCO EJECTOR

[76] Inventor: M. Joseph Conte, 927 Michie Tavern La., Charlottesville, Va. 22902

[21] Appl. No.: 545,411

[22] Filed: Oct. 19, 1995

[51] Int. Cl.[6] ..... A24F 13/24

[52] U.S. Cl. ..... 131/255

[58] Field of Search ..... 131/248, 250, 131/252, 253, 255

[56] References Cited

U.S. PATENT DOCUMENTS

| | | | |
|---|---|---|---|
| 282,764 | 8/1883 | Peavey | 131/254 X |
| 308,906 | 12/1884 | Larsen et al. | 131/254 |
| 703,162 | 6/1902 | Todd, Jr. | 131/255 |
| 1,734,620 | 11/1929 | Giacopini | 131/255 |
| 2,832,354 | 4/1958 | Miller | 131/254 |
| 4,711,254 | 12/1987 | Fleisher et al. | 131/255 X |

OTHER PUBLICATIONS

Famous Smoke Shop Catalog Advertisements for "Bulls-Eye Plucker" (cigar cutter) and Cigar Cutters/Scissors, pp. 3, 4, 42 and 43 of the Holiday 1995 Edition No. DM35 of Famous Smoke Shop Catalog.

Alfred Dunhill Catalog Advertisements for Cigar Cutters and Drill, p. 13 of the Nov. 1995 Issue of the Alfred Dunhill Catalog.

Acces Advertisement for Scissor and Guillotine Cigar Cutters; Jul., 1995 Edition of Nat Sherman Co. Catalog.

Acces Advertisement for Sterling Silver Cigar Punch; Jul., 1995 Edition of Nat Sherman Co. Catalog.

*Primary Examiner*—William H. Grieb

*Attorney, Agent, or Firm*—J. Michael Martinez de Andino

[57] ABSTRACT

A cigar punch and tobacco ejector apparatus comprising a housing having a cylindrical hollow body attached to a base and having an open circular end, and a cutter having a barrel connected to a handle and a slot formed on the barrel adjacent to the handle. The housing is for storing the cutter when not in use. The cutter has a sharp, open-mouthed edge adapted to receive a tip of a cigar, to cut a piece from the cigar, to form a hole in the cigar's tip, and to hold the cut piece when the cigar is moved away from the cutter. A plunger assembly is connected to the cutter. The plunger assembly has a plunger adapted to travel within the cutter's barrel, a collar adapted to being placed over the barrel and to be connected to the plunger through the barrel's slot. A dowell pin is used to connect the collar to the plunger through the slot. The collar slides along the barrel as the dowell pin moves along the slot, thereby allowing the plunger to eject the cigar's cut piece from the cutter.

28 Claims, 2 Drawing Sheets

CIGAR PUNCH AND TOBACCO EJECTOR

DESCRIPTION

1. Field of the Invention

This invention relates to a device designed to puncture a hole in the tip of a cigar and extract the tobacco from the hole and, more specifically, to an improved cigar punch and tobacco ejector for puncturing a hole in the tip of a cigar, eject the tobacco from the puncher and for storing the cigar punch and tobacco ejector for future use.

2. Background Information a. Cigar Piercers

Conventional cigar piercers and cigar cutters employed to form a hole in a cigar and ejecting the tobacco therefrom, or for cutting the end of a cigar to enable one to draw more easily from the cigar when smoking the same store have included piercers such as the cigar piercing device set forth in U.S. Pat. No. 297,956 to Ungerer wherein a means for piercing cigars is disclosed such that when the cigars are smoked tobacco is not also drawn into the mouth. The disclosed device has a slotted tube with a stationary bar around which is arranged a sliding tubular cutter. The tubular cutter is capable of cutting a hole into the cigar and withdrawing the tobacco therefrom. The tubular cutter is connected with a finger piece, such as a sliding collar working on the tubular case, which is limited in its movement by a slot. By projecting the tubular cutter forward and thrusting the same into the cigar a hole is made in the tip of the cigar.

Similarly, U.S. Pat. No. 376,511 discloses a cigar piercer that comprises a tube having a flaring opening to receive the tip of a cigar in the tubular cutter located within the tube. Around the tube there is a sliding movement that is spring biased to travel along a spiral groove located within the tube. The spiral groove serves to turn the cutter when the inner tube is slid inward over a cigar tip.

U.S. Pat. Nos. 436,269; 706,679; 744,893; 1,910,342; and 2,843,135 disclose cigar cutters or piercing devices which have a cutter that is fitted and slides within an outer tube toward the outer tube's open end that receives the tip of a cigar to enable the sliding cutter to cut and form a hole within the cigar's tip. Further, some of the above-mentioned devices, such as in U.S. Pat. Nos. 376,511; 706,679; 1,910,342; and 2,843,135, require the use of a spring means to move the cutter back to its original starting position.

These above-mentioned conventional cigar piercing or cutting devices encounter several problems such as requiring a spring means or having a cutter that moves within an outer tube for cutting and removing the cut piece of cigar from the cigar tip. Such devices can easily have tobacco get loose within the outer tube and causing the sliding ability of the cutter to be greatly reduced. Such tobacco loose can also sometimes get stuck within the spring means further reducing the ability of the cutter to slidably move within the outer tube.

Moreover, the above-mentioned devices do not have a storage means that is easy to hold and leave standing on a desk or a piece of furniture for future use of the device. Also, the above-mentioned devices do not have such a storage means that protects the cutting edge of the cutter from being dented or made dull. Further, the above-mentioned devices do not include a cutter that is simply pressed against a cigar tip for cutting and removing the cut piece of tobacco from the cigar tip, and which does not slide within an outer tube in order to operate. The above-mentioned devices do not include a plunger that moves within the cutter to eject the cut piece of tobacco from the cutting edge of the cutter without requiring the use of a spring means.

In order to overcome the above-mentioned defects in a cigar piercer or cutting device, there is a need for an improved cigar punch and tobacco ejector that includes a non-sliding cutter that fits within a stand for easy storage. There is also a need for an improved cigar punch and tobacco ejector which includes a plunger that does not require the use of a spring means for ejecting the cut piece of tobacco from the cutter.

SUMMARY OF THE PRESENT INVENTION

Accordingly, it is the primary object of the present invention to provide an improved cigar punch and tobacco ejector that includes a non-sliding cutter that is stored within a stand for future use.

It is a further object of this invention to provide an improved cigar punch and tobacco ejector that includes a plunger that travels within the cutter for ejecting the cut piece of tobacco from the cutter and which does not require the use of a spring means.

It is another object of this invention to provide an improved cigar punch and tobacco ejector that includes a non-sliding cutter that is stored within a stand, which keeps the cutting edge of the cutter from being dented or made dull, and that has a plunger that travels within the cutter for ejecting the cut piece of tobacco from the cutter without requiring the use of a spring means. Other objects and advantages of this invention will become apparent from the following description taken in connection with the accompanying drawings wherein are set forth, by way of illustration and example, certain embodiments of this invention.

DETAILED DESCRIPTION OF THE PREFERRED EMBODIMENTS OF THE INVENTION

Before the present improved cigar punch and tobacco ejector is described, it is to be understood that this invention is not limited to a particular cigar punch and tobacco ejector as such may, of course, vary. It is also to be understood that the terminology used herein is for the purpose of describing particular embodiments only, and is not intended to be limiting as the scope of the present invention will be limited only by the appended claims.

Figure 1:
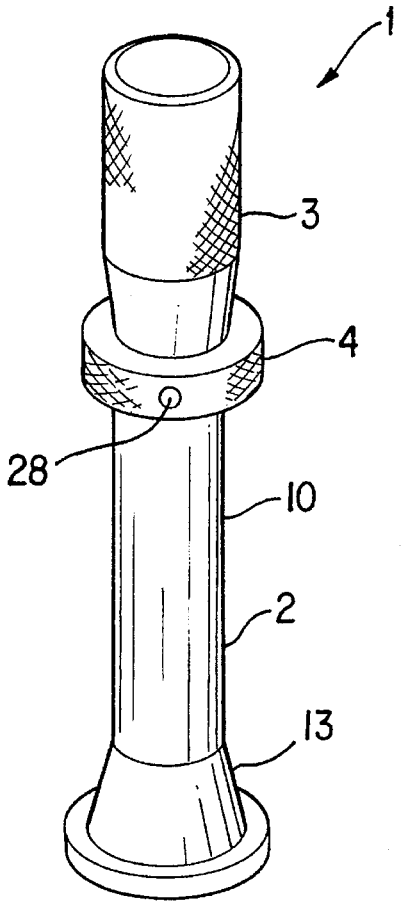
FIG. 1 is a perspective view of a typical embodiment of the cigar punch and tobacco ejector showing the cutter stored within the stand.

Unless defined otherwise, all terms used herein have the same meaning as commonly understood by one of ordinary skill in the art to which this invention belongs. Referring now to the drawings, a typical embodiment of the improved cigar punch and tobacco ejector is shown in FIG. 1, and is generally designated by the reference numeral 1.

Figure 5:
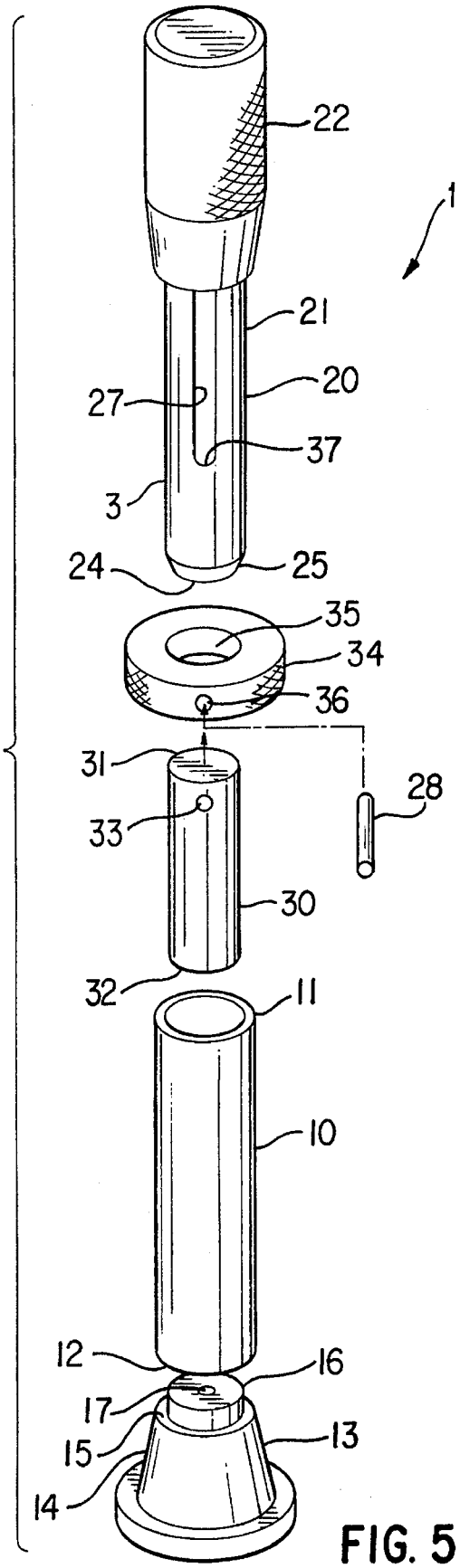
FIG. 5 is an exploded isometric view of the cigar punch and tobacco ejector as shown in FIG. 1.
Figure 7:
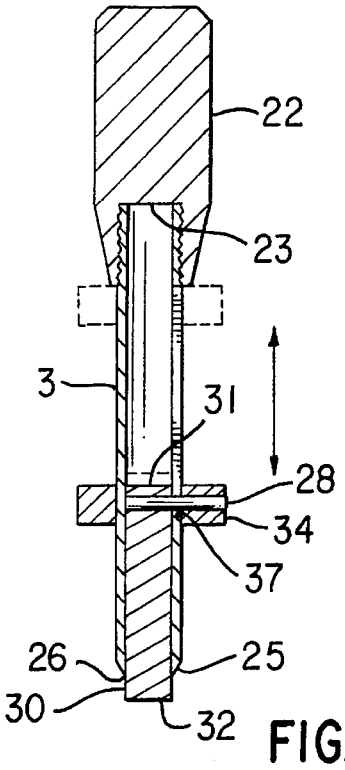
FIG. 7 is a longitudinal section view through the cutter taken along lines 6—6 of FIG. 6 with the plunger in the lower most position.
Figure 6:
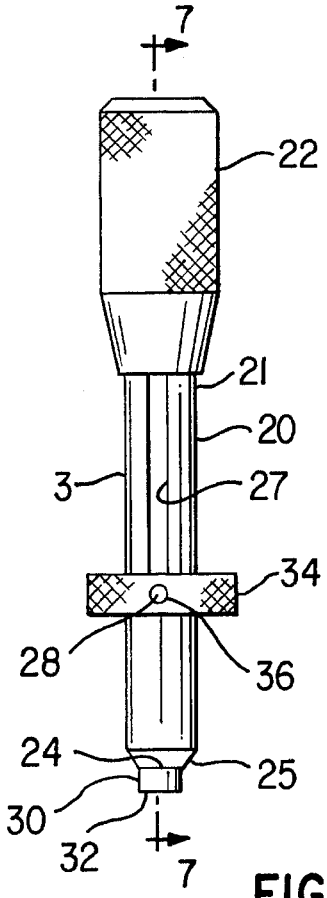
FIG. 6 is an elevational view of the cutter with the plunger in the lower most position.

The improved cigar punch and tobacco ejector 1 comprises a stand 2, a cutter 3 and a plunger assembly 4. As shown in FIGS. 1 and 5, the stand 2 is comprised of a sleeve 10 that can be formed of any suitable materials such as metal, but is preferably formed of aluminum. The sleeve 10 has a cylindrical body with an open end 11 that is adapted to receive the cutter 3, and a second end 12 that is attached to a base 13. The sleeve 10 preferably has a length of 1 and ⅜ inches and has a diameter of ⅜th of an inch. The sleeve 10 has a length that is greater than the length of the cutter 3, such that when the cutter 3 is placed within the sleeve 10, the cutter does not make contact with the base 13. The sleeve 10 is adapted to protect the removably inserted cutter 3 from being dented or made dull.

The base 13 is adapted to sit on a flat surface, such as the top of a desk, and has a conical shaped body 14 with a circular shaped shelf 15 that is located at the top edge of the conical shaped body 14. The conical shaped body 14 is approximately ¼ inch in length and has an extending member 16 that is adapted to receive the second end 12 of the sleeve 10. The extending number 16 extends approximately ⅛th of an inch from the conical shaped body 14. The base 13 also has a cleaning hole 17 located at the center of the base 13 that extends the entire length of the base 13 and is open at the bottom of the base 13 to allow for easy cleaning of the interior of the stand 2. The base 13 can be formed of any suitable material, but is preferably formed of brass. The base 13 has an approximate overall length of ½ of an inch.

Referring to FIGS. 2–7, the cutter 3 is comprised of a punch 20 that has a barrel 21 connected to a handle 22. The barrel 21 is preferably formed of stainless steel and has a cylindrical body with an upper end 23 and a lower end 24. The barrel 21 is approximately 1 and ½ inches in length. The upper end 23 is inserted and attached to the handle 22, which is preferably made of brass. The barrel 21 has an elongated slot 27 formed near the upper end 23 and extends approximately ⅝th of an inch down the length of the barrel 21. The slot 27 is adapted to receive a dowel pin 28 or other connecting means.

Figure 2:
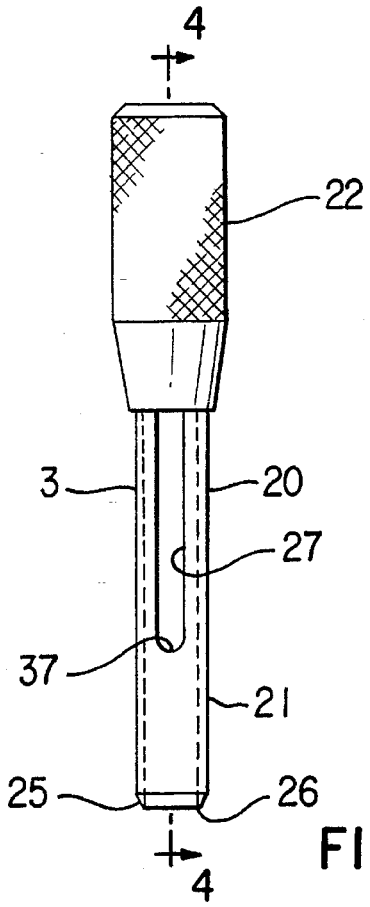
FIG. 2 is a side elevational view of the cutter.
Figure 3:
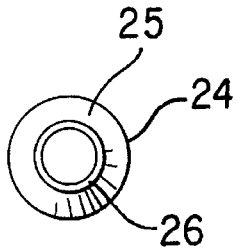
FIG. 3 is an end elevational view of said cutter as seen from the bottom of FIG. 2.
Figure 4:
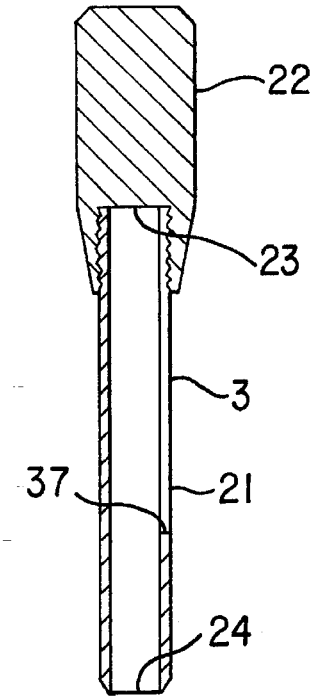
FIG. 4 is a longitudinal section view through said cutter taken along lines 4—4 of FIG. 2.

As shown in FIGS. 2–4, the lower end 24 of the barrel 21 has an inwardly-tapering socket 25 that has a sharp, cutting edge 26. The inwardly-tapering socket 25 is adaptive to receive a tip of a cigar (not shown). The cutting edge 26 when pressed against the tip of the cigar cuts a piece of tobacco out of the cigar tip and forms a ¼ inch diameter hole in the cigar tip (not shown). The cutting edge 26 can be designed to form a ⅛th inch or ⅜th inch diameter hole in the cigar tip (not shown). When the cutter 3 is placed within the stand 2, the stand 2 is adapted to keep the sharp, cutting edge 26 from being dented or made dull.

Referring now to FIGS. 1 and 5–7, the plunger assembly 4 consists of a plunger (or ejector means) 30 that has a cylindrical body with spaced apart first and second ends 31 and 32, respectively. The plunger 30 is approximately ¾ inches long and is adapted to movably travel within the barrel 21 of the cutter 3. The plunger 30 has a first circular shaped hole 33 located adjacent to the first end 31 and extends approximately through the entire width of the plunger 30. The first circular shaped hole 33 is adapted to receive the dowell pin 28. A collar 34, which preferably has a circular shape and has a center hole, is adapted to be positioned over the barrel 21. The collar 34 has a second circular shaped hole 36 that extends through the edge of the collar 34 to the center hole 35. The collar 34 is connected to the plunger 30 when the plunger 30 is inserted within the barrel 21, the collar 34 is placed over the barrel 21, and the first and second circular shaped holes 33 and 36, respectively, and the slot 27 are aligned and the dowell pin 28 is inserted through the second circular shaped hole 36, the slot 27 and into the first circular shaped hole 33. The dowell pin 28 is adapted to movably slide along the edges of the slot 27.

The collar 34 when placed over the barrel 21 of the punch 20 is adapted to travel along the outer surface of the barrel 21 as the dowell pin 28 travels along the slot 27. When the dowell pin 28 reaches the lower most edge 37 of the slot 27, the second end 32 of the plunger 30 extends partially out of the barrel 21 through the inwardly-tapering socket 25. Accordingly, the collar 34 is adapted to move the plunger 30 within the barrel 21. The second end 32 of the plunger 30 is adapted to eject the plug or piece of tobacco located at the lower end 24 of the barrel 21 after the cutter 3 has been used to cut and form a hole at the tip of the cigar.

SUMMARY

In operation, the improved cigar punch and tobacco ejector 1 provides a user with the ability to use and then store a cigar punch and tobacco ejector within a stand 2. When using the improved cigar punch and tobacco ejector 1, a person takes the cutter 3 out of the stand 2 and places the inwardly-tapering socket 25 of the punch 20 over the tip of a cigar. By pressing and slightly twisting the punch 20 down over the tip of the cigar, the cutting edge 26 of the inwardly-tapering socket 25 cuts a ¼ inch hole within the tip of the cigar. A plug or piece of tobacco is left within the lower end 24 when the person removes the punch 20 away from the cigar. By moving the collar 34 in the direction toward the lower end 24 of the barrel 21, the plunger 30 is able to push the plug out of the barrel 21. The person can then restore the cutter 3 within the stand 2 for future use. If the stand 2 begins to accumulate pieces of tobacco from prior use of the cutter 3, then a person can use a pin, needle or some other similar cleaning device to clean the interior of the stand 2. The person inserts the pin through the hole 17 located at the bottom of the base 13 which pushes any tobacco that is stuck at the bottom of the base 13 within the stand 2 upward and free from the extending member 16 of the base 13. By simply turning the stand 2 upside down, the freed tobacco can be removed from the stand 2. The stand 2 is adapted to keep the cutting edge 26 from being dented or made dull by providing a storage means that has a sleeve 10 which is longer than the cutter 3. Accordingly, when the cutter 3 is inserted within the sleeve 10, the cutting edge 26 does not come in contact with any portion of the base 13 and is kept sharp for the next use.

It is to be understood that while certain forms of this invention have been illustrated and described, the invention is not limited thereto, except insofar as such limitations are included in the following claims.

What is claimed and described to be secured by Letters Patent is as follows:

1. A cigar punch and tobacco ejector apparatus comprising:

(a) a housing having a first cylindrical hollow body with opposite spaced apart first and second ends, and a base, said first end having a circular opening, said base having top and bottom surfaces, said second end connected to said top surface of said base;

(b) a cutter having a barrel with opposite spaced apart third and fourth ends, a handle connected to said third end, and a slot formed on said barrel adjacent to said third end, said fourth end having an open-mouthed edge adapted to receive a tip of a cigar, to cut a piece from said tip, to form a hole in said tip, and to hold said cut piece when said cigar is moved away from said cutter, said cutter adapted to being removably inserted within said housing; and (c) a plunger assembly consisting of a plunger having a second cylindrical body with opposite spaced apart fifth and sixth ends, a collar adapted to being placed over said barrel, and a means for connecting said collar to said plunger, said collar adapted to slide over said barrel and be connected to said fifth end of said plunger through said slot by said connecting means, said plunger adapted to movably travel within said barrel, said sixth end of said plunger adapted to eject said cut piece of said cigar from said barrel when said collar is movably slid along said slot in a direction toward said fourth end of said cutter.

2. A cigar punch and tobacco ejector apparatus as set forth in claim 1 wherein said base has a first aperture extending through the entire length of said base and adapted to allow a person to clean the interior of said housing.

3. A cigar punch and tobacco ejector apparatus as set forth in claim 1 wherein said fourth end has a diameter that is approximately ¼ inch wide.

4. A cigar punch and tobacco ejector apparatus as set forth in claim 1 wherein said fourth end has a diameter that is approximately ⅛ inch wide.

5. A cigar punch and tobacco ejector apparatus as set forth in claim 1 wherein said fourth end has a diameter that is approximately ⅜ inch wide.

6. A cigar punch and tobacco ejector apparatus as set forth in claim 1 wherein said housing is adapted to protect said cutter and to keep said open-mouthed edge from being dented and made dull.

7. A cigar punch and tobacco ejector apparatus as set forth in claim 1 wherein said plunger has a second aperture adjacent to said fifth end, and said collar has a third aperture extending to the center of said collar, said connecting means adapted to extend through said third aperture through said slot to said second aperture for connecting said collar to said plunger.

8. A cigar punch and tobacco ejector apparatus as set forth in claim 1 wherein said housing has a length that is greater than the length of said cutter.

9. A cigar punch and tobacco ejector apparatus comprising:

(a) a housing having a first cylindrical hollow body with opposite spaced apart first and second ends, and a base, said first end having a circular opening, said base having top and bottom surfaces, said second end connected to said top surface of said base;

(b) a cutter having a barrel with opposite spaced apart third and fourth ends, a handle connected to said third end, and a slot formed on said barrel adjacent to said third end, said fourth end having a sharp, open-mouthed edge adapted to receive a tip of a cigar, to cut a piece from said tip, to form a hole in said tip, and to hold said cut piece when said cigar is moved away from said cutter, said cutter adapted to being removably inserted within said housing; and (c) a plunger assembly consisting of a plunger having a second cylindrical body with opposite spaced apart fifth and sixth ends, a collar adapted to being placed over said barrel, and a means for connecting said collar to said plunger, said collar adapted to slide over said barrel and be connected to said fifth end of said plunger through said slot by said connecting means, said plunger adapted to movably travel within said barrel, said sixth end of said plunger adapted to extend beyond said sharp, open-mouthed edge of said fourth end and to eject said cut piece of said cigar from said barrel when said collar is movably slid along said slot in a direction toward said fourth end of said cutter.

10. A cigar punch and tobacco ejector apparatus as set forth in claim 9 wherein said plunger has a first aperture adjacent to said fifth end, and said collar has a second aperture extending to the center of said collar, said connecting means adapted to extend through said second aperture through said slot to said first aperture for connecting said collar to said plunger.

11. A cigar punch and tobacco ejector apparatus as set forth in claim 9 wherein said base has a third aperture extending through the entire length of said base and adapted to allow a person to clean the interior of said housing.

12. A cigar punch and tobacco ejector apparatus as set forth in claim 9 wherein said fourth end has a diameter that is approximately ¼ inch wide.

13. A cigar punch and tobacco ejector apparatus as set forth in claim 9 wherein said fourth end has a diameter that is approximately ⅛ inch wide.

14. A cigar punch and tobacco ejector apparatus as set forth in claim 9 wherein said fourth end has a diameter that is approximately ⅜ inch wide.

15. A cigar punch and tobacco ejector apparatus as set forth in claim 9 wherein said housing is adapted to protect said cutter and to keep said sharp, open-mouthed edge from being dented and made dull.

16. A cigar punch and tobacco ejector apparatus as set forth in claim 9 wherein said apparatus has an approximate length of 2 and ¾ inches and said cutter has an approximate length of 1 and ⅝ inches.

17. A cigar punch and tobacco ejector apparatus comprising:

(a) a housing having a first cylindrical hollow body with opposite spaced apart first and second ends, and a base, said first end having a circular opening, said base having top and bottom surfaces, said second end connected to said top surface of said base;

(b) a cutter having a barrel with opposite spaced apart third and fourth ends, a handle connected to said third end, and a slot formed on said barrel adjacent to said third end, said fourth end having a sharp, open-mouthed edge adapted to receive a tip of a cigar, to cut a piece from said tip, to form a hole in said tip, and to hold said cut piece when said cigar is moved away from said cutter, said cutter adapted to being removably inserted within said housing and said handle adapted to being placed adjacent to said first end of said housing when said apparatus is not in use; and (c) a plunger assembly consisting of a plunger having a second cylindrical body with opposite spaced apart fifth and sixth ends, a collar adapted to being placed over said barrel, and a means for connecting said collar to said plunger, said collar adapted to slide over said barrel and be connected to said fifth end of said plunger through said slot by said connecting means, said plunger adapted to movably travel within said barrel, said sixth end of said plunger adapted to eject said cut piece of said cigar from said barrel when said collar is movably slid along said slot in a direction toward said fourth end of said cutter.

18. A cigar punch and tobacco ejector apparatus as set forth in claim 17 wherein said plunger has a first aperture adjacent to said fifth end, and said collar has a second aperture extending to the center of said collar, said connecting means adapted to extend through said second aperture through said slot to said first aperture for connecting said collar to said plunger.

19. A cigar punch and tobacco ejector apparatus as set forth in claim 17 wherein said base has a third aperture extending through the entire length of said base and adapted to allow a person to clean the interior of said housing.

20. A cigar punch and tobacco ejector apparatus as set forth in claim 17 wherein said apparatus has an approximate length of 2 and ¾ inches, said cutter has an approximate length of 1 and ⅝ inches, and said fourth end has a diameter that is approximately ¼ inch wide.

21. A cigar punch and tobacco ejector apparatus as set forth in claim 17 wherein said apparatus has an approximate length of 2 and ¾ inches, said cutter has an approximate length of 1 and ⅝ inches, said fourth end has a diameter that is approximately ⅛ inch wide.

22. A cigar punch and tobacco ejector apparatus as set forth in claim 17 wherein said apparatus has an approximate length of 2 and ¾ inches, said cutter has an approximate length of 1 and ⅝ inches, said fourth end has a diameter that is approximately ⅜ inch wide.

23. A cigar punch and tobacco ejector apparatus as set forth in claim 17 wherein said housing is adapted to protect said cutter and to keep said sharp, open-mouthed edge from being dented and made dull.

24. A cigar punch and tobacco ejector apparatus comprising:

(a) a housing having a first cylindrical hollow body with opposite spaced apart first and second ends, and a base, said first end having a circular opening, said base having top and bottom surfaces a first aperture extending from said top surface to said bottom surface, said second end connected to said top surface of said base, said first aperture adapted to allow a person to clean the interior of said first cylindrical hollow body;

(b) a cutter having a barrel with opposite spaced apart third and fourth ends, a handle connected to said third end, and a slot formed on said barrel adjacent to said third end, said fourth end having a sharp, open-mouthed edge adapted to receive a tip of a cigar, to cut a piece from said tip, to form a hole in said tip, and to hold said cut piece when said cigar is moved away from said cutter, said cutter adapted to being removably inserted within said housing and said handle adapted to being placed adjacent to said first end of said housing when said apparatus is not in use;

(c) a plunger assembly consisting of a plunger having a second cylindrical body with opposite spaced apart fifth and sixth ends with a second aperture adjacent to said fifth end, a collar having a third aperture extending to the center of said collar, said collar adapted to being placed over said barrel, and a means for connecting said collar to said plunger, said connecting means adapted to extend through said third aperture through said slot to said second aperture for connecting said collar to said fifth end of said plunger, said plunger adapted to movably travel within said barrel, said sixth end of said plunger adapted to eject said cut piece of said cigar from said barrel when said collar is movably slid along said slot in a direction toward said fourth end of said cutter; and (d) said housing adapted to protecting said cutter from being dented and for preventing said sharp, open-mouthed edge of said fourth end from being dented and made dull.

25. A cigar punch and tobacco ejector apparatus as set forth in claim 24 wherein said fourth end has a diameter that is approximately ¼ inch wide.

26. A cigar punch and tobacco ejector apparatus as set forth in claim 24 wherein said fourth end has a diameter that is approximately ⅛ inch wide.

27. A cigar punch and tobacco ejector apparatus as set forth in claim 24 wherein said fourth end has a diameter that is approximately ⅜ inch wide.

28. A cigar punch and tobacco ejector apparatus as set forth in claim 24 wherein said apparatus has an approximate length of 2 and ¾ inches and said cutter has an approximate length of 1 and ⅝ inches.

* * * * *

UNITED STATES PATENT AND TRADEMARK OFFICE

CERTIFICATE OF CORRECTION

PATENT NO. : 5,535,763

DATED : July 16, 1996

INVENTOR(S) : Conte

It is certified that error appears in the above-indentified patent and that said Letters Patent is hereby corrected as shown below:

On the title page,

In the section marked [56] please include the following prior art:

| | | | |
|---|---|---|---|
| -- 297,956 | 4/29/1884 | Ungerer | 131/255 |
| 376,511 | 1/17/1888 | Carter | 131/255 |
| 436,269 | 9/09/1890 | Scholer | 131/255 |
| 706,679 | 8/12/1902 | Mountford | 131/255 |
| 744,893 | 11/24/1903 | Bailey | 131/255 |
| 1,434,599 | 11/7/1922 | Field, et al | 131/255 |
| 1,910,342 | 5/23/1933 | Kivikink | 131/255 |
| 2,843,135 | 7/15/1958 | Lisiewski | 131/255 --. |

Signed and Sealed this

Twenty-fourth Day of June, 1997

Bruce Lehman

*Attest:*

BRUCE LEHMAN

*Attesting Officer*

*Commissioner of Patents and Trademarks*